US008551316B2

(12) United States Patent
Wijenberg et al.

(10) Patent No.: US 8,551,316 B2
(45) Date of Patent: Oct. 8, 2013

(54) METHOD OF ELECTRODEPOSITING A METALLIC COATING LAYER CONTAINING NICKEL AND MOLYBDENUM

(75) Inventors: Jacques Hubert Olga Joseph Wijenberg, Amsterdam (NL); Daniël Adriaan De Vreugd, Beverwijk (NL); Ilja Portegies Zwart, Wormer (NL)

(73) Assignee: Hille & Muller GmbH, Dusseldorf (DE)

( * ) Notice: Subject to any disclaimer, the term of this patent is extended or adjusted under 35 U.S.C. 154(b) by 406 days.

(21) Appl. No.: 12/667,286

(22) PCT Filed: Jul. 11, 2008

(86) PCT No.: PCT/EP2008/059124

§ 371 (c)(1),
(2), (4) Date: Feb. 19, 2010

(87) PCT Pub. No.: WO2009/010473

PCT Pub. Date: Jan. 22, 2009

(65) Prior Publication Data

US 2010/0167087 A1 Jul. 1, 2010

(30) Foreign Application Priority Data

Jul. 13, 2007 (EP) ..... 07013801

(51) Int. Cl.
*C25D 3/56* (2006.01)
*C25D 5/14* (2006.01)
*C25D 5/50* (2006.01)

(52) U.S. Cl.
USPC ..... 205/176; 205/178; 205/228; 205/259

(58) Field of Classification Search
USPC ..... 205/259
See application file for complete search history.

(56) References Cited

U.S. PATENT DOCUMENTS

| | | | | |
|---|---|---|---|---|
| 2,599,178 | A | 6/1952 | Holt et al. | |
| 3,417,005 | A | 12/1968 | Baig | |
| 3,878,067 | A * | 4/1975 | Tremmel | 205/260 |
| 3,947,331 | A | 3/1976 | Kinh et al. | |
| 4,462,874 | A * | 7/1984 | Tomaszewski et al. | 205/292 |
| 4,552,628 | A * | 11/1985 | Wilcox et al. | 205/265 |
| 5,853,556 | A * | 12/1998 | Wieczerniak | 205/101 |

(Continued)

FOREIGN PATENT DOCUMENTS

| | | |
|---|---|---|
| EP | 1 278 899 | 1/2003 |
| JP | 61204392 | 9/1986 |
| JP | 200582856 A | 3/2005 |

OTHER PUBLICATIONS

F. A. Lowenheim, Electroplating, McGraw-Hill Book Company, New York, 1978, pp. 138-139.*

*Primary Examiner* — Patrick Ryan
*Assistant Examiner* — William Leader
(74) *Attorney, Agent, or Firm* — Novak Druce Connolly Bove + Quigg, LLP

(57) ABSTRACT

This invention relates to a method for producing a metallic coating layer comprising nickel and molybdenum on an electrically conductive substrate by electrodeposition from an aqueous solution including nickel salts, gluconate anions and citrate anions wherein the substrate acts as the cathode and wherein molybdate is added and wherein the pH of the aqueous solution is adjusted between 5.0 and 8.5. The invention also relates to an electrically conductive substrate provided with such a metallic coating layer electrodeposited from the aqueous solution.

22 Claims, 3 Drawing Sheets

(56) References Cited

U.S. PATENT DOCUMENTS

| | | | | |
|---|---|---|---|---|
| 6,911,137 | B2 | 6/2005 | Van Der Weijde | |
| 7,553,401 | B2 * | 6/2009 | Gebhart et al. | 205/96 |
| 2004/0074776 | A1 | 4/2004 | Van Der Weijde | |
| 2004/0103938 | A1 | 6/2004 | Rider | |

* cited by examiner

METHOD OF ELECTRODEPOSITING A METALLIC COATING LAYER CONTAINING NICKEL AND MOLYBDENUM

CROSS-REFERENCE OF RELATED APPLICATIONS

This application is a §371 National Stage Application of International Application No. PCT/EP2008/059124, filed on 11 Jul. 2008, claiming the priority of European Patent Application No. 07013801.1 filed on 13 Jul. 2007.

This invention relates to a method of producing a metallic coating layer comprising nickel and molybdenum on an electrically conductive substrate by electrodeposition from an aqueous solution. The invention further relates to a substrate provided with a metallic coating layer comprising nickel and molybdenum.

The good mechanical properties and resistance to hot corrosion, which are offered by certain nonferrous nickel (Ni) base and molybdenum (Mo) base (maximum 30%) alloys, possibly containing chromium (Cr), are well known. A commercial alloy, known as Hastelloy®, a registered trade mark of Haynes International, Inc. has a composition of about 59% Ni, 23% Cr, 16% Mo and 2% copper (Cu). This alloy is used when excellent corrosion resistance in acid environment is required. Hastelloy® C-2000 has a composition of about 59% Ni, 23% Cr, 16% Mo and 2% Cu and is used when corrosion resistance is required in reducing and oxidising environments. However, despite their favourable properties these alloys, their high price and the difficulties presented in their use have prevented widespread use.

As a consequence, there has been an interest in depositing a coating containing Ni and Mo to a substrate which confers the favourable properties of the coating to the substrate. The material of the substrate should either be electrically conductive material, such as a metal, or be rendered superficially conductive by a suitable coating. Examples of such metals are iron, iron alloys such as ordinary steels, slightly alloyed steels, special steels (stainless steels, Maraging steels, etc.), aluminium and its alloys, nickel and its alloys, copper and cobalt, as well as the respective alloys of these two metals, titanium and metals of the same group, as well as their alloys, and ceramics rendered conductive by a suitable coating (graphite for example).

JP2005082856 discloses a plating liquid having a pH of between 8 and 11 for providing a Ni—Mo layer comprising nickel salt, molybdate and gluconate. The pH is adjusted by the addition of aqueous ammonia.

U.S. Pat. No. 2,599,178 discloses a plating bath composition for plating Ni—Mo layers comprising nickel sulphate, sodium molybdate and citric acid for plating at a pH of 4 to 8. $NH_4(OH)$ is used to adjust the pH of the plating bath.

The coating layers deposited from these baths are prone to cracking. A further disadvantage of these baths is that the temperature of the electrodeposition operation has to be kept low, because otherwise ammonia fumes will be released from the baths. This necessitates cooling of the bath, or electrodeposition at very low temperatures, which may adversely affect the quality of the electrodeposited layer, coating composition and will adversely affect the electrodeposition speed because of the lower conductivity of the bath which leads to a higher cell voltage and hence a lower current density or a higher electricity consumption.

It is an object of the invention to provide a method for producing a metallic coating layer comprising Ni and Mo on an electrically conductive substrate.

It is also an object of the invention to provide a method for producing a metallic coating layer comprising Ni and Mo on an electrically conductive substrate electrodepositing from an aqueous solution using a high current density together with a high current efficiency.

It is also an object of the invention to provide a method for producing a metallic coating layer comprising Ni and Mo on an electrically conductive substrate electrodepositing from an aqueous solution which has good adhesion properties to the substrate.

Many electrically conductive materials are sensitive to acidic plating baths. For instance, iron, zinc or aluminium dissolve in an acid plating bath. Aluminium is often provided with a thin zinc layer prior to electrodepositing a metal coating upon the aluminium substrate to improve the adhesion of the metal coating to the aluminium substrate. This thin zinc layer may be applied by immersing the substrate in a zincate solution. This thin zinc layer excludes the use of acidic plating baths, because the zinc layer will dissolve very rapidly in the acidic bath.

It is therefore also an object of the invention to provide a method for producing a metallic coating layer comprising Ni and Mo on an electrically conductive substrate electrodepositing from an aqueous solution which has a slightly acidic or neutral pH.

Figure 1:
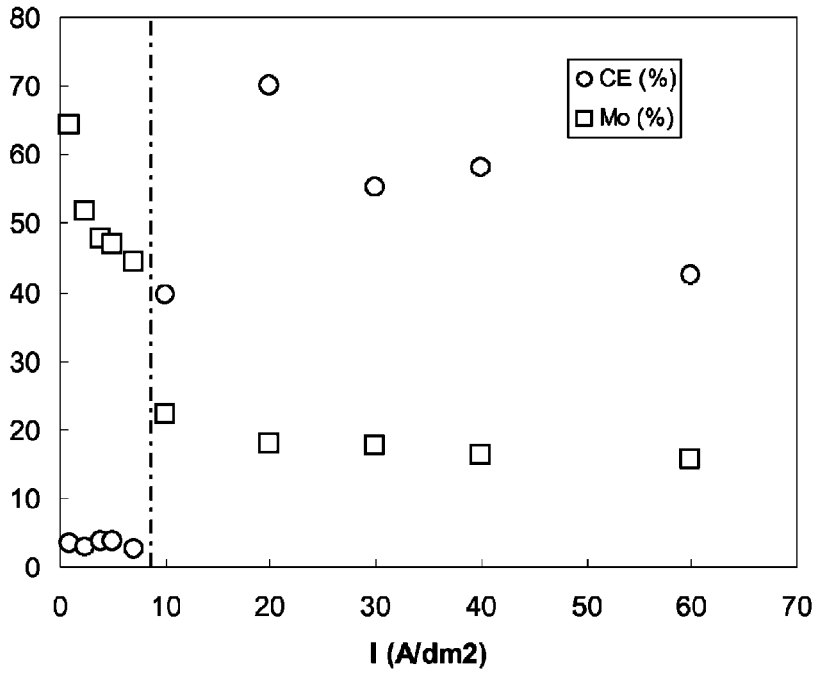
FIG. 1 is a depiction of the relationship between current density I ($A/dm^2$) and current efficiency (CE), and between current density I ($A/dm^2$) and molybdenum concentration of the deposited coating (Mo).
Figure 2:
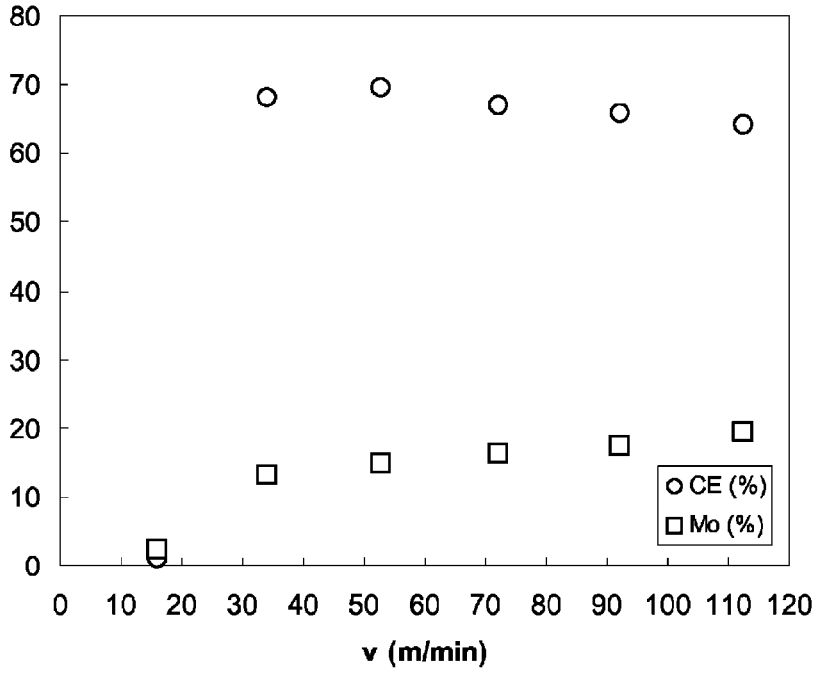
FIG. 2 is a depiction of the relationship between line speed v (m/min) and current efficiency (CE), and between line speed v (m/min) and molybdenum concentration of the deposited coating (Mo).
Figure 3:
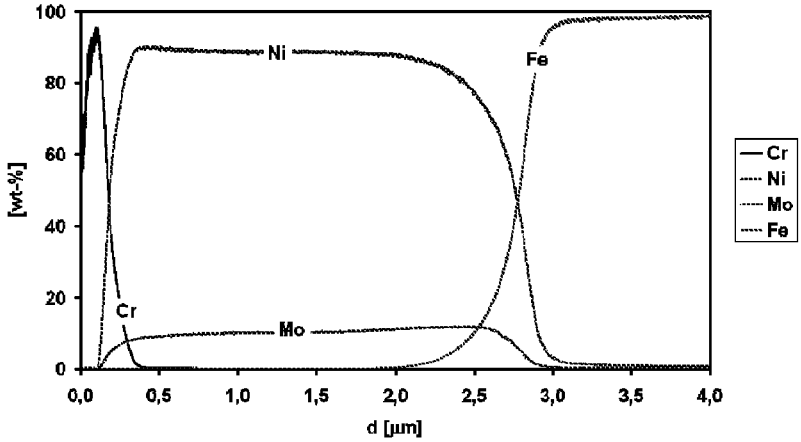
FIGS. 3 to 6 are GDOES profiles of the Ni—Mo—Cr layers.
Figure 4:
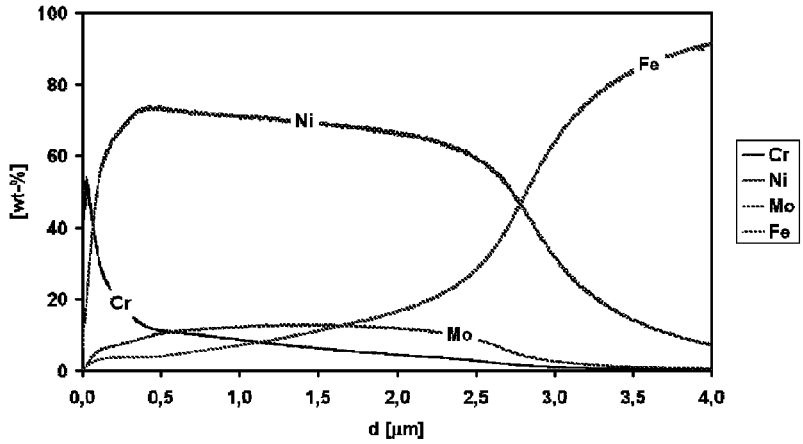
Figure 5:
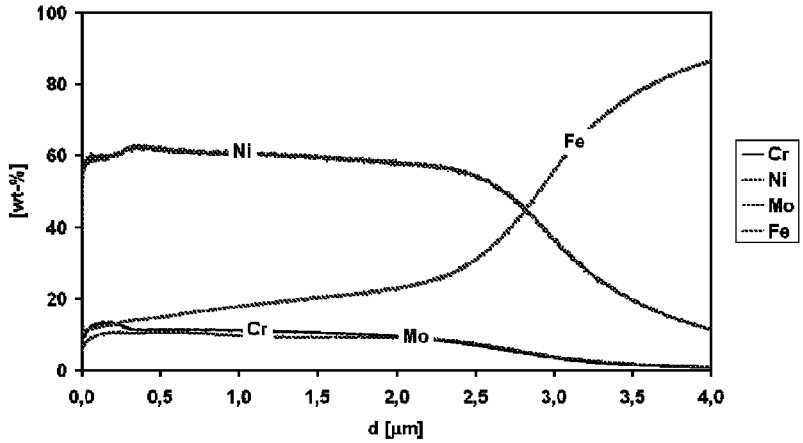
Figure 6:
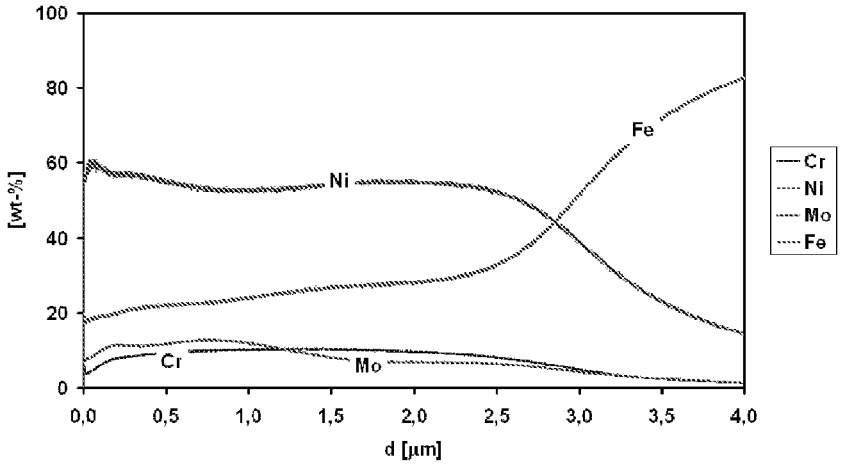

One or more of the objects are achieved by a method for producing a metallic coating layer comprising nickel and molybdenum on an electrically conductive substrate by electrodeposition from an aqueous solution comprising nickel salts, gluconate anions and citrate anions wherein the substrate acts as the cathode and wherein a molybdate is added and wherein the pH of the aqueous solution is adjusted between 5.0 and 8.5.

The nickel salts will generally be present partially or wholly in the form of nickel sulphate although said nickel salts may also be present partly or in whole in the form of other salts, particularly nickel chloride or nickel sulfamate.

The nickel salts provide Ni-ions, and the use of nickel chloride increases the electrical conductivity of the bath and renders it possible to use a lower interelectrode voltage. It also prevents the formation of a passive (oxide) film in case Ni is used as the anode in the electrodeposition method. The citrate serves as a complexing and buffering agent. Ni, which would otherwise precipitate as Ni-hydroxide at pH above 5.6 is retained in solution by the presence of citrate in the form of a soluble Ni complex. However, at the concentration needed for keeping Ni in solution, citrate induces undesirable side effects, which interfere substantially with the performance of the bath. At high concentrations, citrate reduces the dissolution of the Ni anode in case Ni is used as the anode in the electrodeposition method. It was surprisingly found, that the addition of gluconate permits the retention of the favourable properties of citrate to the exclusion of its unfavourable ones.

It will be clear that the nickel and the molybdenum in the metallic coating are substantially or even completely metallic nickel and metallic molybdenum and are present as a substantially or even completely metallic nickel-molydenum alloy coating layer.

U.S. Pat. No. 3,947,331 discloses an aqueous solution for forming an electrolytic deposit containing Mo and Ni. The bath contains a mixture of sodium molybdate, Ni-chloride, Ni-sulphate and sodium citrate. This plating bath contains citrate and ammonia as complexing and buffering agents. The ammonia is added to keep the pH in the range of 9 to 11. This high pH is necessary to keep the complexes of the organic acid anion and the Mo-ions and Ni-ions in solution. The deposited layer according to this disclosure is subjected to a thermal treatment at a temperature between 700 and 1200° C. for a period of 2 to 24 hours to improve the corrosion resistance and the adherence of the coating layer to the substrate.

In an embodiment of the invention a stress reliever is added to the plating bath to relieve or prevent internal stresses in the coating and thus prevent cracking of the coating. Such a stress reliever may be ammonium or triethanolamine. The ammonium may be added to the bath as an ammonium salt, and preferably as ammonium sulphate or ammonium molybdate ($(NH_4)_2MoO_4$). The latter salt has the advantage that no new anion types are added to the plating bath as the molydate-anion is used in the deposition.

In an embodiment of the invention the gluconate and citrate are added to the solution as sodium gluconate and/or sodium citrate. It is preferable that the gluconate and citrate are added to the solution as sodium gluconate and sodium citrate.

In an embodiment of the invention the aqueous solution comprises molybdate, such as ammonium molybdate ($(NH_4)_2 MoO_4$) or an alkali metal molybdate, such as sodium molybdate ($Na_2MoO_4$), at a concentration of at least 0.008 mol/l. A suitable maximum concentration of the molybdate is 0.10 mol/l. A suitable minimum concentration of the molybdate is 0.015 mol/l. It has been found that when the concentration of the molybdate is held within this range, that proper selection of the plating parameters results in the deposition of a Ni—Mo alloy layer onto the electrically conductive substrate. At lower concentrations, the Mo-content in the alloy becomes too low, and at higher concentrations the Mo in the Ni—Mo alloy layer is not completely reduced, and the layer contains undesirable amounts of Mo-oxides. Moreover, the current efficiency drops to a very low level of below 5%.

In the invention the pH of the aqueous solution is adjusted between 5.0 and 8.5. A suitable minimum is a pH of 5.5 and a suitable maximum is a pH of 7.5. By controlling the pH between these values, the pH is held in the range where Ni can be effectively retained in solution by the presence of citrate in the form of a soluble nickel complex. At low pH values (i.e. acid environments), the substrate may be attacked, for instance in case of a Zn-substrate, or the Ni will not be effectively retained in solution by the presence of citrate in the form of a soluble Ni-complex. At a pH above 8.5 the equilibrium of the complexing reactions shifts so that the Ni-ions will not be effectively retained in solution. A suitable maximum pH was found to be 7.8. The inventors found that a preferable range for the pH of the bath was between 5.5 and 7.5, and more preferably below 7.0 (i.e. a slightly acidic to neutral bath). The pH of the bath may be adjusted by the addition of e.g. sulphuric acid ($H_2SO_4$), ammonia ($NH_3$) or ammonium ($NH_4OH$). Such periodic adjustments result in a constant coating composition and a constant cathodic yield.

In an embodiment of the invention the aqueous solution is maintained at a temperature between 30 and 80° C., preferably between 40 and 70° C., more preferably between 45 and 65° C. It has been found that when selecting the temperature of the plating bath in this range there is no need for cooling the plating bath during plating, the plating efficiency can be selected very high and the conductivity of the bath is optimal. Moreover, by limiting the bath temperature to the said maximum, the evaporation of the bath is limited. An advantage of limiting the evaporation of the solvent is that the concentrations of the plating solution do not change as a result of the evaporation.

In an embodiment the cathodic current density is chosen such that the current efficiency is at least 30%. It was found that when the cathodic current density is chosen too low, that the current efficiency is also very low, thereby resulting in a very uneconomical plating process. Moreover, the Mo in the alloy layer appeared to be at least partly oxidised, leading to a non-metallic looking, coloured coating layer on the substrate. These coating layers appeared not to possess the desired properties. If the cathodic current density is chosen such that the current efficiency is at least 30%, the coating layers have a metallic appearance and possess the desired mechanical and corrosion properties.

In an embodiment the cathodic current density is at least 8.5 A/dm$^2$, more preferably at least 10 A/dm$^2$. It was found that below a certain threshold of current density, that the current efficiency remains very low, resulting in a very uneconomical plating process. Moreover, the Mo in the alloy layer appeared to be incompletely reduced, leading to a non-metallic looking, coloured coating layer on the substrate. It was found that when the current density is at least 8.5 A/dm$^2$ for the electrodeposition from the aqueous solution according to the invention, the current density lies above this critical threshold. A current density of at least 10 A/dm$^2$ may be used to take fluctuations form the ideal process conditions into account.

In an embodiment the cathodic current density is at least 12.5 A/dm$^2$ and/or at most 40 A/dm$^2$, preferably wherein the cathodic current density is between 15 A/dm$^2$ and 30 A/dm$^2$. It was found that the best combination of current efficiency, current density, coating composition, coating layer properties and appearance was obtained when the current density is at least 12.5 A/dm$^2$ and at most 40 A/dm$^2$. In a preferable embodiment the cathodic current density is between 15 A/dm$^2$ and 30 A/dm$^2$ because this range provides the highest current efficiency and current density combination. For high speed strip plating, a minimum current density of at least 25 A/dm$^2$ is preferable.

In an embodiment the mass transfer rate during electrodeposition is enhanced. The mass transfer rate in a strip plating line may be enhanced by increasing the line speed or by agitation, by which the thickness of the diffusion layer adjacent to the moving strip is reduced. Surprisingly, it was also found that the Mo content in the coating increases with increasing mass transfer rate. Agitation can be realised by means of eductors or by introducing a moving or rotating body between the moving strip and the anodes. Examples of means to enhance the mass transfer rate during electrodeposition are disclosed in EP1278899, the contents of which are hereby included by reference, particularly sections [0008] to [0026].

In a preferred embodiment of the invention the metallic coating layer comprising Ni and Mo is coated by a metallic chromium layer and the coating system comprising the metallic coating and the chromium layer deposited thereupon are subjected to a diffusion annealing step to form a metallic coating layer comprising a Ni—Mo—Cr alloy layer. By this method a coating layer with the composition of a Ni—Mo—Cr alloy is obtained, thus conveying the properties thereof to a substrate, but at a much lower overall cost in comparison to the Ni—Mo—Cr alloy. In case the substrate is steel, Fe will also diffuse into the Ni—Mo—Cr layer, thus effectively resulting in an Fe—Ni—Mo—Cr alloy layer on a steel substrate. Similar diffusion of the substrate atoms may occur for other substrates, resulting in a (substrate atoms-Ni—Mo—Cr) alloy layer on top of the substrate.

In relation to the annealing conditions to achieve the said Ni—Mo—Cr alloy layer on the electrically conductive substrate it is important that the annealing atmosphere is reducing to avoid oxidation of the chromium. Such a reducing atmosphere can be obtained by annealing in $H_2$-gas at a temperature of at least 825° C. and a low dewpoint. Other annealing atmospheres-dewpoint combinations may also be possible as long as the atmosphere remains reducing towards Cr. Preferably the dewpoint is below −50° C. The higher the annealing temperature, the faster the diffusion of Cr into the Ni—Mo alloy layer and the faster the formation of the Ni—Mo—Cr alloy layer. Because of the annealing temperature, this embodiment of the invention is limited to the use of substrates able to withstand the annealing temperature of at least 825° C. The nature of the substrate also determines the maximum temperature. For a steel substrate, a practical maximum temperature is 1150° C., but preferably the annealing temperature is below 1100° C., more preferably below 1000° C. to avoid undesirable microstructural changes of the substrate, such as grain growth. For a continuous production process, for instance in a strip annealing process, the annealing temperature is preferably at least 850° C. By appropriately selecting the process parameters a metallic coating layer can be provided onto the substrate wherein the metallic coating layer consists substantially of said Ni—Mo—Cr alloy with only small variations in concentration of Ni, Mo and Cr over the thickness of the alloy layer.

In an embodiment of the invention the aqueous solution comprises

- 0.53 to 1.06 mol/l (mole/liter) $NiSO_4$
- 0.028 to 0.68 mol/l $NiCl_2$
- 0.008 to 0.08 mol/l alkali metal molybdate
- 0.45 to 0.54 mol/l sodium citrate
- 0.023 to 0.207 mol/l sodium gluconate
- 0.055 to 1.33 mol/l ammonium from a suitable ammonium salt such as ammonium sulphate and wherein the pH is maintained between 5.5 and 8.5, preferably between 5.5 and 7.5, and more preferably below 7.0.

The alkali metal molybdate is preferably sodium molybdate, although lithium molybdate or potassium molybdate may sometimes be used. The salt of an organic acid is preferably sodium citrate, but tartrates and acetates may sometimes be used as well.

Preferably the aqueous solution comprises

- 0.53 to 1.06 mol/l $NiSO_4$
- 0.23 to 0.34 mol/l $NiCl_2$
- 0.008 to 0.08 mol/l alkali metal molybdate
- 0.45 to 0.53 mol/l sodium citrate
- 0.046 to 0.14 mol/l sodium gluconate
- 0.055 to 1.33 mol/l ammonium from a suitable ammonium salt such as ammonium sulphate The total molar concentration of the nickel salts may be within the range 0.53 to 1.06 mol/l. The alkali metal molybdate, such as sodium molybdate, may be in the range 0.008 to 0.08 mol/l.

The temperature of the bath is preferably held at the selected value for the whole electrodeposition for the coating to have a constant composition throughout its thickness. A value of about 50° C. provides excellent results.

Different types of anodes may be used,

- an insoluble anode, for example of platinum or platinised metal, such as platinised titanium or Ti/Ir-oxide; the concentrations of molybdenum and of nickel metal in the bath should then periodically be replenished by suitable additions of the salts of these metals used as constituents of the bath;
- a soluble nickel anode in which case the need to replenish the nickel salts is diminished or absent;
- a soluble anode constituted of an alloy of molybdenum and nickel (preferably a molybdenum-nickel alloy having a content of molybdenum corresponding to that desired for the deposit), in which the need to add nickel and/or molybdenum salts to the bath is diminished or absent.

The addition of the nickel or the alloy may be performed by an addition in the form of nickel or nickel-molybdenum alloy pellets in an insoluble basket, such as a titanium basket. In a particular embodiment the substrate is plated by depositing said anodically dissolved nickel and/or molybdenum on at least part of the substrate, which acts as cathode. In an embodiment part of the anodes is masked out using adjustable masking means that are controlled and guided dependent on strip width and/or the desired coating thickness distribution. These masking means may comprise shutters or blinds. Preferably the basket acts as a current collector because it is made of a material with a low electrical resistance allowing for good electrical contact with the metal pellets and being electrochemically inert in the electrolyte. An automated supply system may be provided to add pellets to the anode basket automatically.

The cathodic current density must be greater than the threshold to avoid the inclusion of oxidic Mo in the coating layer.

In an embodiment of the invention, the Ni—Mo layer, and optionally the Cr layer, is deposited onto a substrate which is provided in the form of a strip, for instance a hot-rolled or cold-rolled strip, or even a cast strip. By using the aqueous solution according to the invention the combination of high current efficiency and current density make high speed plating possible. The plating process can be implemented as a continuous plating process and the optional diffusion annealing can also be performed in a continuous manner. The continuous plating and the continuous annealing may be performed with or without intermediate coiling and uncoiling of the strip. Using this process strips, for instance steel strips, can be provided with a Ni—Mo layer, or a Ni—Mo—Cr—Fe layer as described herein.

According to a second aspect of the invention an electrically conductive substrate with a metallic coating layer comprising nickel and molybdenum is provided wherein the coating layer is obtained by electrodeposition from an aqueous solution according to the invention.

The substrate provided with the coating layer provides a substrate having the surface of a very expensive nickel-based alloy, and the related mechanical and corrosion properties, combined with the properties of the substrate. By proper selection of the substrate this may be a light metal, or a metal with excellent formability, but low corrosion resistance. By providing such a substrate with an electrodeposited coating layer from the aqueous solution the optimal combination of properties can be obtained, or the properties of the nickel-based alloys can be obtained just by providing a thin layer onto a low-cost substrate or onto a substrate having particular properties which are different from those of the coating layer, e.g. a conductive ceramic material.

In an embodiment of the invention the metallic coating layer comprising nickel and molybdenum comprises at least 5% in wt of Mo and/or at most 30% in wt of Mo, preferably between 10% in wt of Mo and 20% in wt of Mo. In an embodiment of the invention the metallic coating layer comprising nickel and molybdenum comprises at least 10% of Mo. These embodiments provide good corrosion properties.

In an embodiment of the invention the metallic coating layer comprising nickel and molybdenum is provided with a metallic chromium layer.

In an embodiment of the invention the chromium from the metallic chromium layer has at least partly diffused into the metallic coating layer comprising nickel and molybdenum thereby forming a Ni—Mo—Cr alloy layer. In a preferable embodiment the thickness of the Ni—Mo layer may be up to 4 μm, and the Cr layer is between about 0.1 and 1 μm. The Ni—Mo layer is at least 0.1 μm, but preferably at least 0.5 μm. Preferably the Ni—Mo layer is between about 1 and 3 μm, and the Cr layer is between about 0.3 and 0.7 μm. The total thickness of the Ni—Mo—Cr alloy layer after annealing of about 1 to 4 μm appeared to provide good corrosion properties, good adherence and good appearance.

Preferable electrically conductive substrates for the method according to the invention are steel and its alloys, aluminium and its alloys, copper and its alloys.

The Ni—Mo layer produced from the aqueous solution according to the invention may be used in flexible CIS solar cells. To this end a nickel-molybdenum contact layer is deposited on a suitable substrate such as a strip-shaped copper film.

It should be noted that when it would be required that the diffusion annealed layer also comprises other element such as e.g. copper, that these could be added to the diffusion annealed layer by also plating a copper layer onto the substrate prior to the annealing. During the subsequent annealing the copper, or any other plated metal, would diffuse into the layer thereby alloying the layer with copper or the other plated metal(s).

The invention will now be explained in more detail by the following, non limitative examples.

An aqueous solution having the composition according to Table 1 was used (M=mol/l). As stress reliever ammonium sulphate was used.

TABLE 1

Plating solution

| compound | formula | concentration g/l | concentration M (or mol/l) |
|---|---|---|---|
| Nickel sulphate | $NiSO_4$ (× 6 $H_2O$) | 142 | 0.540 |
| Nickel chloride | $NiCl_2$ (× 6 $H_2O$) | 30 | 0.126 |
| Sodium molybdate | $Na_2MoO_4$ (× 2 $H_2O$) | 12.1 | 0.050 |
| Ammonium sulphate | $(NH_4)_2SO_4$ | 34 | 0.257 |
| Sodium citrate | $Na_3C_6H_5O_7$ (× 2 $H_2O$) | 140 | 0.476 |
| Sodium gluconate | $Na_2C_{12}H_{22}O_{14}$ | 30 | 0.138 |

For all these examples also, the temperature of the bath was 50° C. (±about 2° C.) and its pH 6.1 (±about 0.2).

TABLE 2

CE, % Mo and appearance as a function of current density for plating solution according to table 1.

| I (A/dm$^2$) | CE (%) | % Mo | Appearance |
|---|---|---|---|
| 1 | 3.4 | 64.3 | Purple/blue |
| 2.5 | 2.9 | 51.9 | Light blue |
| 4 | 3.7 | 47.9 | Brown |
| 5 | 3.6 | 47.1 | Brown/yellow |
| 7 | 2.6 | 44.5 | Yellow |
| 10 | 39.5 | 22.1 | Metallic |

TABLE 2-continued

CE, % Mo and appearance as a function of current density for plating solution according to table 1.

| I (A/dm$^2$) | CE (%) | % Mo | Appearance |
|---|---|---|---|
| 20 | 70.1 | 17.8 | Metallic |
| 30 | 55.3 | 17.7 | Metallic |
| 40 | 58.1 | 16.2 | Metallic |
| 60 | 42.4 | 15.8 | Metallic |

These examples show that a very high current efficiency can be obtained at high current densities. The coatings have very low internal stresses and no crack formation has been observed. The plated product shows excellent formability, for instance in an Erichsen test using a cup height of 5 mm. No ammonia fumes were released from the plating bath during plating, despite the relatively high temperature of the plating solution. The samples produced at the lower current densities do not have a metallic appearance but are coloured. SEM/EDX measurements revealed that the coloured samples had a large molybdenum content, which was partly oxidised. Moreover, the current density and the current efficiency are low, leading to an uneconomical process. There appears to be a threshold value at about 8.5 A/dm$^2$ above which a steep increase in current efficiency is observed. Although the molybdenum content in the nickel-molybdenum layer decreases, all molybdenum is metallic, and the amount of molybdenum in the layer is comparable to that of a commercially available molydenum containing nickel alloys such as Hastelloy®-B. Moreover, GDOES-analysis revealed that the molybdenum concentration is constant over the thickness of the layer. Coating thicknesses between 0 and 5 μm could be achieved in a very short time. A 3.08 μm thick coating could be achieved at a current density of 20 A/dm$^2$ in 76 seconds, and the Mo-concentration was 15.1 wt %. A current efficiency of 68% was achieved.

When the tests are repeated in an agitated bath using a rotating cylinder electrode the effect of line speed in an industrial coating line can be studied. Again the threshold value of about 8.5 A/dm$^2$ was found above which metallic coatings are deposited. By varying the rotation speed of the RCE, mass transfer rate is varied. By using an equivalent mass transfer rate, the rotation speed of the RCE can be translated into a line speed of a plating line. A linear increase in molybdenum concentration in the deposited coating layer was observed with increasing line speed from 13.2 wt % at 34.1 m/min to 19.4 wt % at 112.6 m/min at 20 A/dm$^2$ current density. The current efficiency slightly decreased linearly from 68.1 to 64 over the same range of line speeds. At very low line speeds the mass transfer rate becomes too low, and the current efficiency collapses to about 1%.

TABLE 2

Current efficiency and Mo-content as function of line speed at 20 A/dm$^2$.

| Line speed, v (m/min) | CE (%) | % Mo |
|---|---|---|
| 16.1 | 0.9 | 2.4 |
| 34.1 | 68.1 | 13.2 |
| 53.0 | 69.5 | 14.7 |
| 72.4 | 67.0 | 16.1 |
| 92.3 | 65.7 | 17.4 |
| 112.6 | 64.0 | 19.4 |

A 2.5 μm Ni—Mo layer was deposited onto a low carbon steel having a thickness of 0.21 mm (stone finish) at a current density of 20 A/dm$^2$ from the plating solution according to Table 1. A 1.0 and a 2.5 μm Cr layer was deposited on top of the Ni—Mo layer from a 250 g/l $CrO_3$, 1.2 g/l sulphate, 4 g/l $H_2SiF_6$ (55° C., 50 A/dm$^2$) plating solution. This multilayer coating system was subsequently subjected to diffusion annealing in a reducing atmosphere at 900° C. for 9 minutes in a 100% $H_2$(g) gas atmosphere and a dewpoint below −50° C. The samples were tested in a 0.1M $Na_2SO_4$+2 ppm NaF, pH adjusted to 4.0 by addition of $H_2SO_4$. The corrosion current was monitored as a function of time at 0.8 V vs. Ag/AgCl reference electrode. The 1.0 μm Cr-layer led to the formation of an alloy with the right amount of Cr in the alloy. An 0.5 μm yielded an alloy layer with too low a Cr-content.

In FIGS. 3 to 6 the resulting GDOES profiles of the Ni—Mo—Cr layers are shown, clearly showing a progressing alloying at longer annealing times (0, 1, 4 and 9 minutes respectively). Measurements of the corrosion properties revealed that the samples passivate quickly and show excellent corrosion resistance. By properly selecting the process parameters of the plating and the subsequent annealing, suitable process parameters for an industrial continuous or batchwise coating and annealing line can be easily determined.

Figure 7:
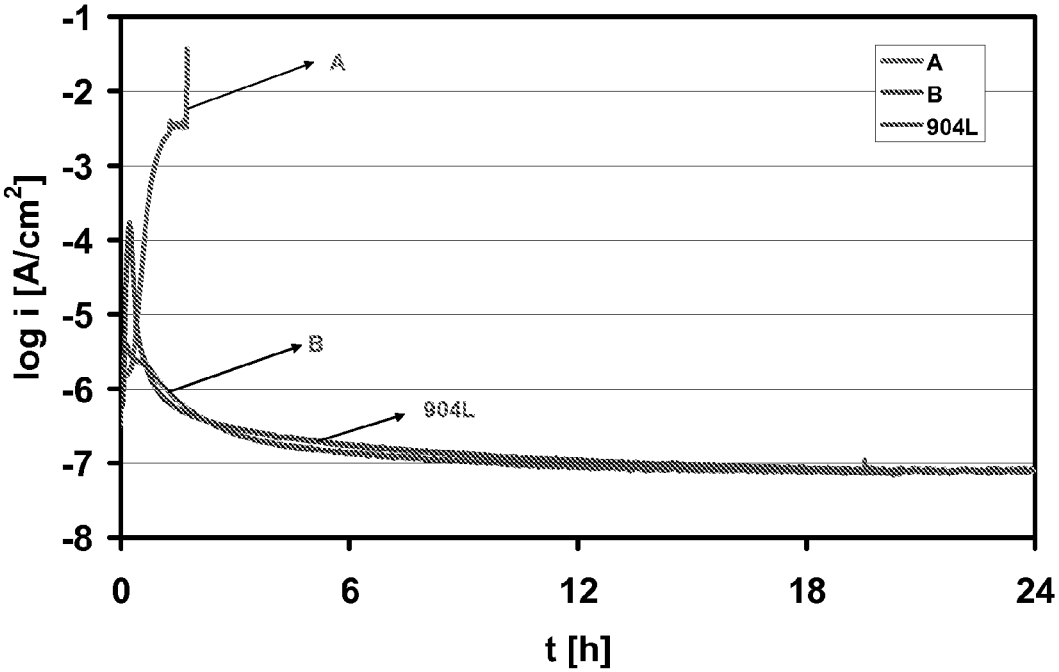
FIG. 7 shows the corrosion current density as a function of time.

FIG. 7 shows the corrosion current density as function of the time for a low-carbon steel substrate with a 2.5 mm NiMo layer and a top layer of 1.0 mm Cr in the as-plated condition (A) and the diffusion annealed condition (B) compared to a 904L steel. The samples were tested in phosphoric acid at a pH of 2, which is a more severe test than the pH4 sulphuric acid test described above.

FIG. 7 shows that the as-plated layer performs very poorly under these circumstances, but the diffusion annealed layer shows very low current densities and consequently an excellent passive layer, and shows identical behaviour compared to a 904L steel. The 904L steel has a composition of 19% Cr, 24% Ni, 4% Mo and 1.2% Cu.

The invention claimed is:

1. A method for producing a metallic coating layer comprising nickel and molybdenum on an electrically conductive substrate by electrodeposition from an aqueous solution comprising nickel salts, gluconate anions and citrate anions wherein the substrate acts as the cathode and wherein molybdate is added and wherein the pH of the aqueous solution is adjusted between 5.0 and 8.5;

wherein the aqueous solution comprises 0.53 to 1.06 mol/l $NiSO_4.6H_2O$ 0.028 to 0.68 mol/l $NiCl_2.6H_2O$ 0.008 to 0.10 mol/l ammonium molybdate or an alkali metal molybdate 0.45 to 0.54 mol/l sodium citrate 0.023 to 0.207 mol/l sodium gluconate 0.055 to 1.33 mol/l ammonium from an ammonium salt;

wherein bath temperature is 30-80° C.; and wherein current density is 12.5 A/dm$^2$-60 A/dm$^2$.

2. The method according to claim 1, wherein ammonium sulphate is added for relieving or preventing internal stresses in the coating layer.

3. The method according to claim 1, wherein the cathodic current density is chosen such that the current efficiency is at least 30%.

4. The method according to claim 1, wherein the cathodic current density is 30 to 60 A/dm$^2$.

5. The method according to claim 1, wherein the cathodic current density is at least 12.5 A/dm$^2$ and at most 40 A/dm$^2$.

6. The method according to claim 1, wherein the cathodic current density is at least 20 A/dm$^2$ and at most 40 A/dm$^2$.

7. The method according to claim 1, wherein the metallic coating layer comprising nickel and molybdenum is coated by a metallic chromium layer and wherein the coating system comprising the metallic coating and the chromium layer are subjected to a diffusion annealing step to form a metallic coating layer comprising a Ni—Mo—Cr alloy layer.

8. The method according to claim 7, wherein the metallic coating layer consists essentially of said Ni—Mo—Cr alloy.

9. The method according to claim 1, wherein the aqueous solution comprises 0.008 to 0.08 mol/l alkali metal molybdate.

10. The method according to claim 9, wherein the pH is maintained between 5.75 and 7.25.

11. The method according to claim 9, wherein sodium citrate is at most 0.476 mol/liter.

12. The method according to claim 1, wherein triethanolamine is added for relieving or preventing internal stresses in the coating layer.

13. The method according to claim 1, wherein the cathodic current density is 25-60 A/dm$^2$.

14. The method according to claim 1, wherein the aqueous solution is maintained at a temperature between 45 and 80° C.

15. The method according to claim 1, wherein the cathodic current density is 40-60 A/dm$^2$.

16. The method according to claim 1, wherein the aqueous solution comprises 0.015-0.10 mol/l ammonium molybdate or an alkali metal molybdate the pH of the aqueous solution is adjusted between 5.5 to less than 7.0 and the bath temperature is 45-65° C., and the current density is 15 A/dm$^2$-30 A/dm$^2$.

17. The method according to claim 16, wherein the aqueous solution comprises 0.05-0.10 mol/l sodium molybdate.

18. The method according to claim 1, wherein the aqueous solution has 0.45 to 0.53 mol/l sodium citrate.

19. The method according to claim 1, wherein the aqueous solution comprises 0.53 to 1.06 mol/l $NiSO_4.6H_2O$ 0.126 to 0.34 mol/l $NiCl_2.6H_2O$ 0.008 to 0.10 mol/l alkali metal molybdate 0.45 to 0.53 mol/l sodium citrate 0.046 to 0.14 mol/l sodium gluconate 0.055 to 1.33 mol/l ammonium from a suitable ammonium salt such as ammonium sulphate;

bath temperature is 30-80 C;

current density 12.5 A/dm$^2$-50 A/dm$^2$.

20. The method according to claim 1, wherein the aqueous solution comprises 0.015-0.10 mol/l ammonium molybdate or an alkali metal molybdate.

21. A method for producing a metallic coating layer comprising nickel and molybdenum on an electrically conductive substrate by electrodeposition from an aqueous solution comprising nickel salts, gluconate anions and citrate anions wherein the substrate acts as the cathode and wherein molybdate is added and wherein the pH of the aqueous solution is adjusted between 5.0 and 8.5;

wherein the aqueous solution comprises 0.54 to 1.06 mol/l $NiSO_4.6H_2O$ 0.126 to 0.68 mol/l $NiCl_2.6H_2O$ 0.015 to 0.10 mol/l molybdate selected from the group consisting of ammonium molybdate and alkali metal molybdate 0.45 to 0.53 mol/l sodium citrate 0.046 to 0.14 mol/l sodium gluconate 0.055 to 1.33 mol/l ammonium from an ammonium salt;

wherein bath temperature is 45-65° C.; and wherein current density is 12.5 A/dm$^2$-50 A/dm$^2$.

22. The method according to claim 21, wherein the aqueous solution comprises

| compound | Formula | concentration g/l | concentration M (or mol/l) |
|---|---|---|---|
| Nickel sulphate | $NiSO_4$ (× 6 $H_2O$) | 142 | 0.540 |
| Nickel chloride | $NiCl_2$ (× 6 $H_2O$) | 30 | 0.126 |
| Sodium molybdate | $Na_2MoO_4$ (× 2 $H_2O$) | 12.1 | 0.050 |
| Ammonium sulphate | $(NH_4)_2SO_4$ | 34 | 0.257 |
| Sodium citrate | $Na_3C_6H_5O_7$ (× 2 $H_2O$) | 140 | 0.476 |
| Sodium gluconate | $Na_2C_{12}H_{22}O_{14}$ | 30 | 0.138 |

and wherein the pH is maintained at 6.1±0.2.

* * * * *